United States Patent [19]

Yasuda et al.

[11] 4,380,386

[45] Apr. 19, 1983

[54] METHOD FOR CONTROLLING PREFATIGUING ILLUMINATION OF A PHOTOSENSITIVE MEMBER

[75] Inventors: Kazuo Yasuda; Akihiko Tamura; Yoshimitsu Nakamura, all of Hachioji, Japan

[73] Assignee: Konishiroku Photo Industry Co., Ltd., Hino, Japan

[21] Appl. No.: 283,811

[22] Filed: Jul. 16, 1981

[30] Foreign Application Priority Data

Jul. 29, 1980 [JP] Japan ..... 55-104025

[51] Int. Cl.[3] ..... G03G 21/00

[52] U.S. Cl. ..... 355/3 R; 355/15; 355/67; 355/77

[58] Field of Search ..... 355/3 R, 15, 3 DD, 67–69, 355/77; 430/31, 97

[56] References Cited

U.S. PATENT DOCUMENTS

| | | | |
|---|---|---|---|
| 3,558,307 | 1/1971 | Carlson | 355/3 R |
| 4,110,026 | 8/1978 | Farley | 355/3 R |
| 4,162,845 | 7/1979 | Smith et al. | 355/69 |
| 4,290,690 | 9/1981 | Noda et al. | 355/69 |

*Primary Examiner*—Richard L. Moses

*Attorney, Agent, or Firm*—Jordan B. Bierman; Linda Bierman

[57] ABSTRACT

Actuation of a prefatiguing lamp is selectively controlled in accordance with the measured time interval between successive copying operations. In substantially continuous copying where the measured interval is less than a first predetermined time period, no prefatiguing illumination is provided. Where the measured interval exceeds a second, longer predetermined time period, full illumination is provided. When the measured interval is between the first and second predetermined periods, partial illumination is provided by appropriate reduction in the operating voltage impressed upon the prefatiguing lamp.

4 Claims, 3 Drawing Figures

METHOD FOR CONTROLLING PREFATIGUING ILLUMINATION OF A PHOTOSENSITIVE MEMBER

BACKGROUND OF THE INVENTION

1. Field of the Invention

The present invention relates to an electrophotographic copying machine having an auxiliary light source by which prefatigue is given to a photoconductor prior to a copying operation, particularly to the improvements of the technology having been described in John L. Harman and John G. Eliot United State application Ser. No. 801,115 (corresponding Japanese Patent Laid Open to Publication No. 148444/1978).

2. Description of the Prior Art

Generally, in an image forming means using a photosensitive member such as selenium, that is for example, an electrophotographic copying machine, phenomena such as "fog" are sometimes observed on the copies obtained at the initial stage of copying operation. In a photosensitive layer on the photosensitive member at the initial stage of copying, said phenomenon caused by the facts that the electric resistance is extremely high and the electric current leakage is less and, therefore, that the high electric charge is apt to be accumulated thereby.

In order to solve a problem of this sort, a copying operation has so far been performed, as described in the Japanese Patent Laid Open to Publication No. 148444/1978, so that preliminary rotations can be given to a drum type photosensitive member on every copying operation, an auxiliary lamp can be lit under the preliminary rotation, and the photosensitive layer is fatigued therewith, and then the copying operation can be performed. However, in a controlling method of this sort, preliminary rotations are done on every copying operation, therefore the time spent becomes longer and gives a difficulty to high speed copying feasibility. Also in the controlling method, a photosensitive member is fatigued at every time of the copying operation, and the copy-image density is lowered when the number of copies is increased.

SUMMARY OF THE INVENTION

An object of the present invention is to obtain a method for controlling an electrophotographic copying machine and the like, wherein a photosensitive layer is not fatigued improperly and a high speed copying operation can be carried out.

An object of the present invention can be achieved by a method for controlling an electrophotographic copying machine, which comprises; lighting an auxiliary light source for which is prefatigued photosensitive member for leveling a surface potential differences of said photosensitive member caused during the period of time from the initial copying operation to successive copying operation, and changing a light amount from said auxiliary light source corresponding to the intervals of copying operation.

DETAILED DESCRIPTION OF THE PREFERRED EMBODIMENTS

Figure 1:
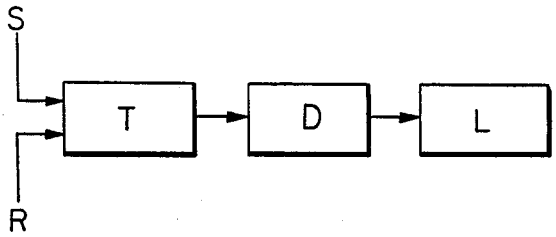
FIG. 1 is a block diagram illustrating a controlling method of the present invention.

The details of the invention are now explained referring to the example shown in the drawings attached hereto:

FIG. 1 is a block diagram illustrating a method for control of the present invention, wherein the output signal of timer circuit T actuated by each copying interval, is fed in the driving circuit D of auxiliary light L by which a photosensitive layer is fatigued. That is to say, in said timer circuit T, a copy finish signal is fed in as a setting signal S, and as for the copy finish signal, a copy delivery signal, a return signal of a document glass plate, or the like can be used for. And, to the timer circuit T, a copy order signal for a succeeding copy is given as a reset signal, therefore, a time interval between a preceeding copy and the succeeding copy is determined in the timer circuit T.

Figure 2:
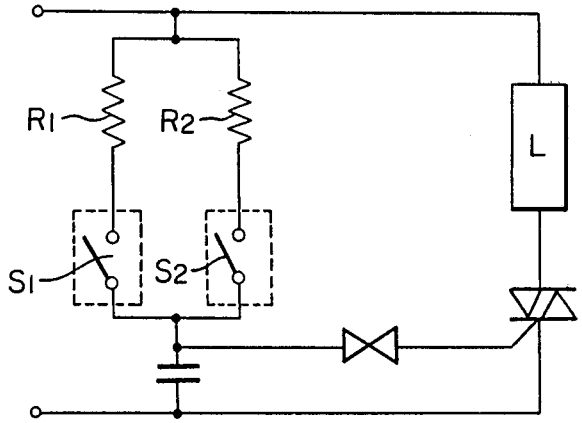
FIG. 2 is a circuit diagram of an example of driving circuits.

In the case of the illustrated example, three kinds of output signals are dispatched from timer circuit T according to the copying intervals and are inputted to driving circuit D shown in FIG. 2. In FIG. 2, driving circuit D has a pair of variable resistors, R1 and R2, and relays, S1 and S2, which are made by the output from said timer circuit T, are connected respectively in series to said resistors, R1 and R2.

Figure 3:
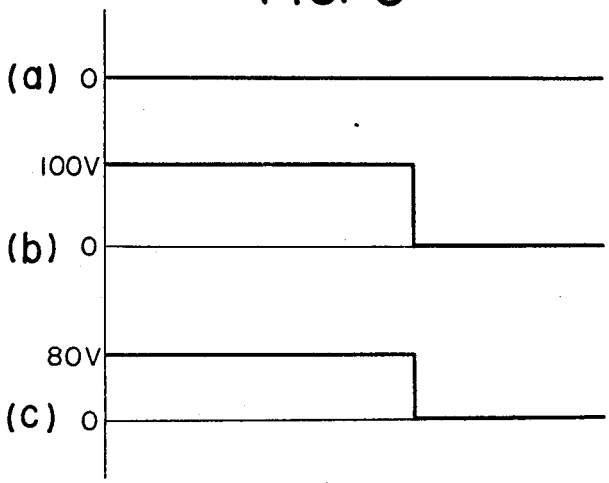
FIG. 3 is an illustration of the operational modes of an auxiliary light source.

On account of the above mentioned constitution, the illustrated example is to operate in a mode shown in FIG. 3.

Firstly, in the case of a continuous copying operation, particularly in the case that the copying intervals are very short (e.g., three seconds or shorter) such as the case of a continuous copying operation under the use of an automatic document feeder, an operation stop signal is dispatched from timer circuit T and driving circuit D shown in FIG. 3 is not actuated, and any preliminary rotation of a photosensitive drum is not made [refer to the mode (a) in FIG. 3]. Consequently, in a copying machine, a continuous copying operation omitting a preliminary rotation therefrom is done.

And, in the case that the copying intervals are longer than a certain period of time (e.g., three minutes or longer), relay S1 is made by an instruction from timer circuit T, a prescribed voltage (e.g., 100 V) is applied to auxiliary light source L and a photosensitive layer is prefatigued, and thereafter, a copying operation is commenced [refer to the mode (b) in FIG. 3].

And, in the case that the copying intervals are within the period of time described in the above two cases, (e.g., the period of time between three seconds and three minutes), relay S2 is made by an instruction of timer circuit T and voltage (e.g., 80 V) that is lower than the prescribed voltage is applied. Therefore, there is no fatigue on the photosensitive layer in vain because the photosensitive drum is preliminarily rotated under the lighting of the auxiliary light source L which was reduced the lighting by 40–50% [refer to the mode (c) in FIG. 3].

As explained above, according tot he present invention, there is nothing lowered in image quality by unnecessarily worsening the photosensitive layer, and the copying speed can by improved by omitting preliminary rotation in the case that the copying intervals are short as described in the aforesaid example.

What is claimed is:

1. In a copying machine which includes a photosensitive member for receiving a latent image in the course of a copying operation during which a reproduction is produced by the machine, and an auxiliary light source operable to illuminate the photosensitive member and thereby prefatigue the member prior to a copying operation during which a latent image is received thereon, the improvement comprising a method of controlling the operation of the auxiliary light source, comprising:

measuring the time interval between the completion of each copying operation and initiation of the next succeeding copying operation; and controlling the operation of the auxiliary light source at the initiation of each copying operation in accordance with the latest measured time interval such that the amount of prefatiguing illumination on the photosensitive member is varied in substantially direct relation to the length of the measured time interval, whereby the photosensitive member is appropriately prefatigued in accordance with the measured time interval between successive copying operations.

2. In a method in accordance with claim 1, said control of the operation of the auxiliary light source comprising:

omitting operation of the auxiliary light source so as not to thereby illuminate the photosensitive member prior to a copying operation where the measured time interval does not exceed a first predetermined period of relatively short duration;

operating the auxiliary light source to illuminate the photosensitive member with light of a preselected amount where the measured time interval exceeds a second predetermined period greater than said first predetermined period; and operating the auxiliary light source to illuminate the photosensitive member with light in an amount less than said preselected amount where the measured time interval is between said first and second predetermined periods.

3. In a method in accordance with claim 2, said operation of the auxiliary light source to illuminate the photosensitive member with light of a preselected amount comprising impressing a predetermined operating voltage on the light source, and said operation of the auxiliary light source to illuminate the photosensitive member with light in an amount less than said preselected amount comprising impressing an operating voltage of less than said predetermined voltage on the auxiliary light source.

4. In a method in accordance with claims 2 or 3, said first predetermined period being three seconds, and said second predetermined period being three minutes.

* * * * *